US005584728A

United States Patent [19]

Cheng

[11] Patent Number: 5,584,728

[45] Date of Patent: Dec. 17, 1996

[54] MODULAR CONNECTOR ASSEMBLY WITH VARIABLY POSITIONED UNITS

[75] Inventor: Lee-Ming Cheng, Cupertino, Calif.

[73] Assignee: Hon Hai Precision Ind. Co., Ltd., Taipei, Taiwan

[21] Appl. No.: 344,953

[22] Filed: Nov. 25, 1994

[51] Int. Cl.[6] ..... H01R 13/00

[52] U.S. Cl. ..... 439/637; 439/701

[58] Field of Search ..... 439/636, 637, 439/630, 633, 634, 59, 60, 62, 629, 701

[56] References Cited

U.S. PATENT DOCUMENTS

| | | | |
|---|---|---|---|
| 3,042,895 | 7/1962 | Bonhomme | 439/701 |
| 5,013,263 | 5/1991 | Gordon et al. | 439/630 |
| 5,024,609 | 6/1991 | Piorunneck | 439/637 |
| 5,190,480 | 3/1993 | Chau et al. | 439/637 |

FOREIGN PATENT DOCUMENTS

| | | | |
|---|---|---|---|
| 3001634 | 1/1993 | WIPO | 439/637 |

*Primary Examiner*—Hien D. Vu

[57] ABSTRACT

An elongated modular connector assembly (1) comprises a plurality of connector modules (10, 12) each having an insulative housing (14) and a plurality of contacts (20) therein. Every two adjacent connector modules (10,12) are connected to each other in an end-to-end relationship. An external fastening means (30) latchably aligns such every two adjacent connector modules (10,12) together in the lengthwise direction of the whole connector assembly (1) so that such connector assembly (1) can lengthwise extend itself by adding additional modules thereto to meet the requirements of increasing signal and/or power transmission.

7 Claims, 4 Drawing Sheets

FIG,2

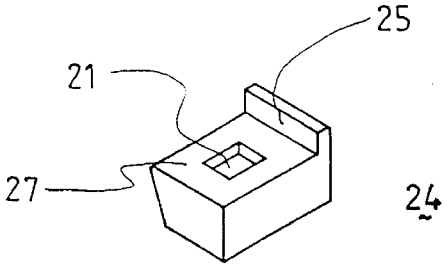
FIG,4A
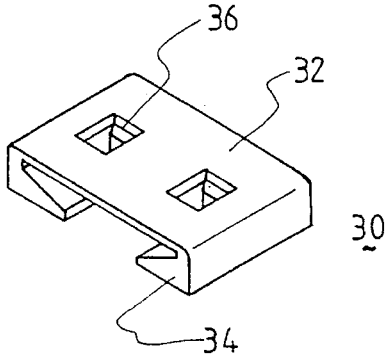
FIG,4B
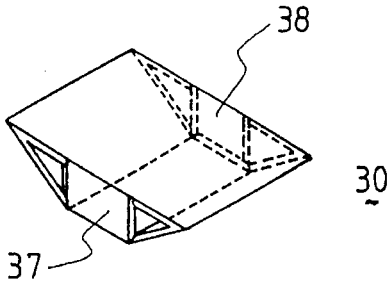
FIG,5
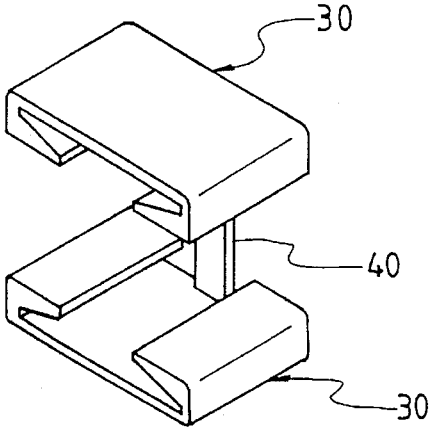
FIG,6
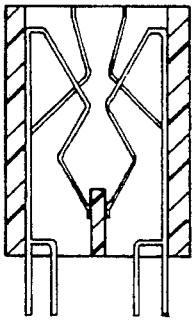
FIG,7A
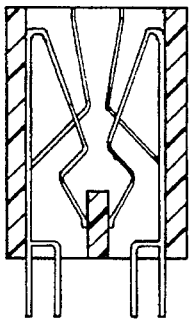
FIG,7B

MODULAR CONNECTOR ASSEMBLY WITH VARIABLY POSITIONED UNITS

BACKGROUND OF THE INVENTION

1. Field of the Invention

The invention relates to modularized connector assemblies, especially to an improvement of U.S. Pat. No. 5,190,480. Such improvement includes at least two connector modules to form the whole connector assembly wherein connector modules can exchange their positions with each other.

2. The Prior Art

U.S. Pat. No. 5,190,480 discloses an all-in-one electrical connector having at least a power region and a signal region within a unitary insulative housing for receiving a board-edge device or a board therein. Because more and more functions are requested for the computer, it is naturally required for such all-in-one connector to increase its length for receiving more contacts therein for signal and/or power transmission. Unfortunately, the longer the connector becomes, the more warpage it tends to have along its lengthwise direction. Such warpage precludes the board-edge device or the board from correct insertion into the connector. The present invention discloses a plurality of modules used for forming such all-in-one connector assembly which is substantially of an enormous length for enclosing a large number of contacts therein.

The concept of using plural modular cells for an elongated connector assembly may be found in U.S. Pat. Nos. 4,343,528, 4,556,628, 4,596,436, 4,820,169, 5,024,609, 5,057,028, 5,090,911, 5,096,435, 5,125,854, 5,145,411, 5,184,961, 5,169,324 and 5,314,357. Most of the aforementioned prior arts use a securing frame to fasten the corresponding connector modules thereto wherein the adjacent two modules are separated from each other by the partition of the frame therebetween. This fixedly dimensioned structure precludes not only the expansibility or the extendibility of the whole connector assembly, but also the interchangeability of the internal modules.

Accordingly, an object of the invention is to provide a flexible modular connector assembly, which allows not only the extendibility or the expansibility of the whole connector assembly along the lengthwise direction, but also the interchangeability of the combined modules with each other.

SUMMARY OF THE INVENTION

In accordance with an aspect of the invention, an elongated modular connector assembly comprises a plurality of connector modules each having an insulative housing and a plurality of contacts therein. Every two adjacent connector modules are connected to each other in an end-to-end relationship. An external fastening means latchably aligns such two adjacent connector modules together in the lengthwise direction of the whole connector assembly so that such connector assembly can lengthwise extend itself by adding modules thereto to meet the requirements of increasing signal and/or power transmission.

In accordance with another aspect of the invention, each module comprises engagement means for latchable engagement with the external fastening means, and such engagement means substantially protrude from two sides of the housing of the module without jeopardizing uniformity and completeness of the original module housing, thus maintaining the structural strength of the module.

In accordance with another aspect of the invention, each module is generally of a card edge connector wherein a central slot extends through the whole housing in the lengthwise direction for reception of a portion of a board-edge device or a board. Two rows of contacts are positioned by two sides of the slot, and in communicable engagement with the board-edge device or the board inserted in the slot.

BRIEF DESCRIPTION OF THE DRAWINGS

FIG. 4 (A) is a perspective view of the wedge block of another embodiment.

FIG. 4(B) is a perspective view of the clip to correspond to the wedge block of FIG. 4(A).

FIG. 5 is a perspective view of the clip of a third embodiment.

FIG. 6 is a perspective view of the clip of a fourth embodiment.

FIG. 7(A) and FIG. 7(B) are portions of cross-sectional views of two different module to show the contacts of the different modules are positioned at different levels.

DETAILED DESCRIPTION OF THE PREFERRED EMBODIMENT

References will now be made in detail to the preferred embodiments of the invention. While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
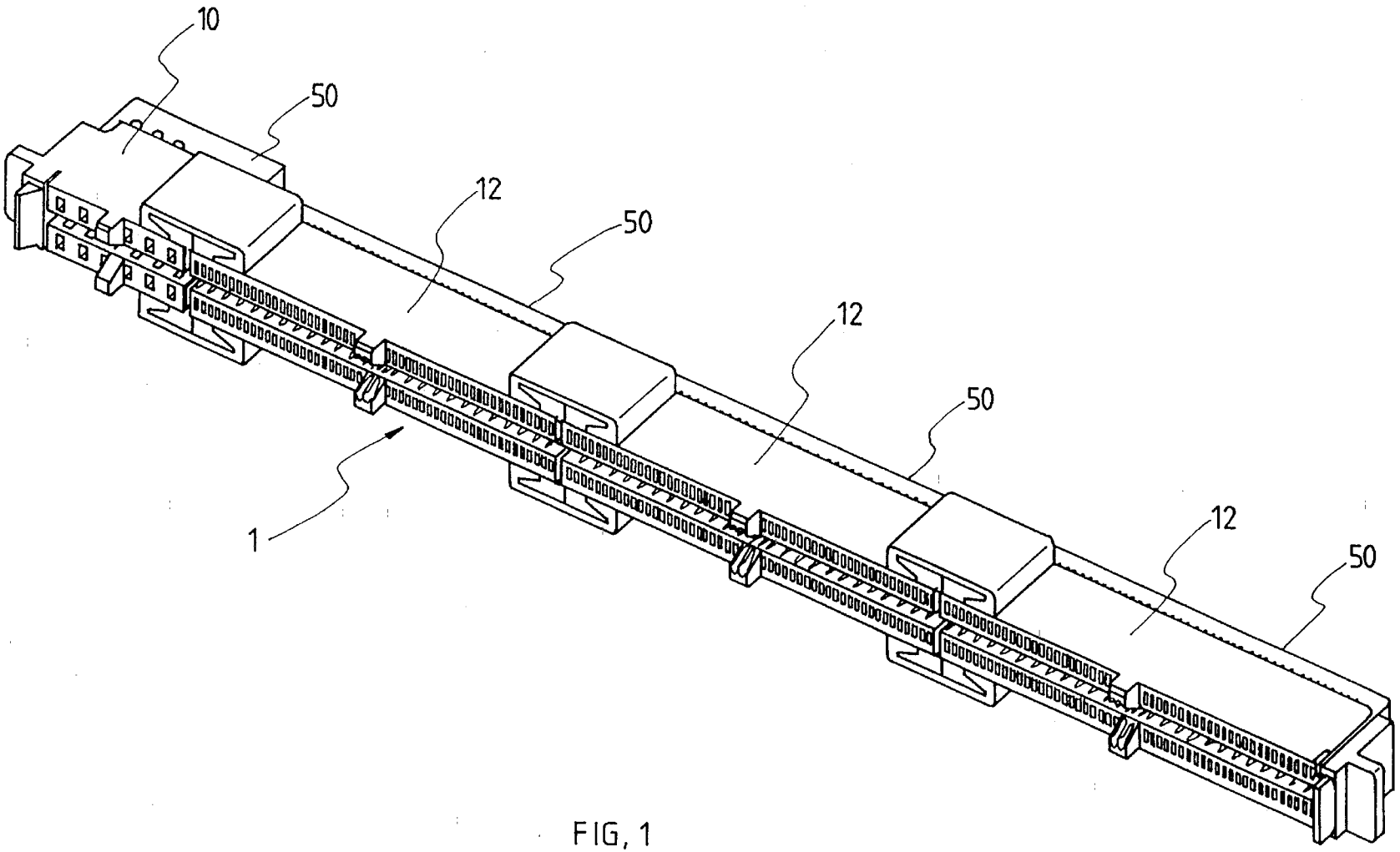
FIG. 1 is a perspective view of an assembled connector assembly, without contacts therein, of a presently preferred embodiment according to the present invention, such connector assembly being adapted to be with covers on the rear side for sandwiching flat cables (not shown) therebetween.

It will be noted here that for a better understanding, most of like components are designated by like reference numerals throughout the various figures in the embodiments. Attention is now directed to FIG. 1 wherein a modular connector assembly 1 includes three power connector module 10 and a signal connector module 12. Also referring to FIGS. 2 and 3, each signal module 12 comprises an elongated insulative housing 14 having a central slot 16 extending therein along its lengthwise direction for receiving an edge portion of a board (not shown) therein.

Two rows of cavities 18 are positioned by two sides of the slot 16, respectively, for receiving a corresponding number of contacts 20 therein wherein each cavity 18 communicates with the slot 16 and thus the corresponding contact 20 in the cavity 18 extends into the slot 16 for electrical and mechanical engagement with the corresponding pad on the edge portion of the board. The detailed structure relation between the contact 20 and the housing 14 may be referred to the aforementioned U.S. Pat. No. 5,190,480 to which the invention makes the improvements.

Figure 3:
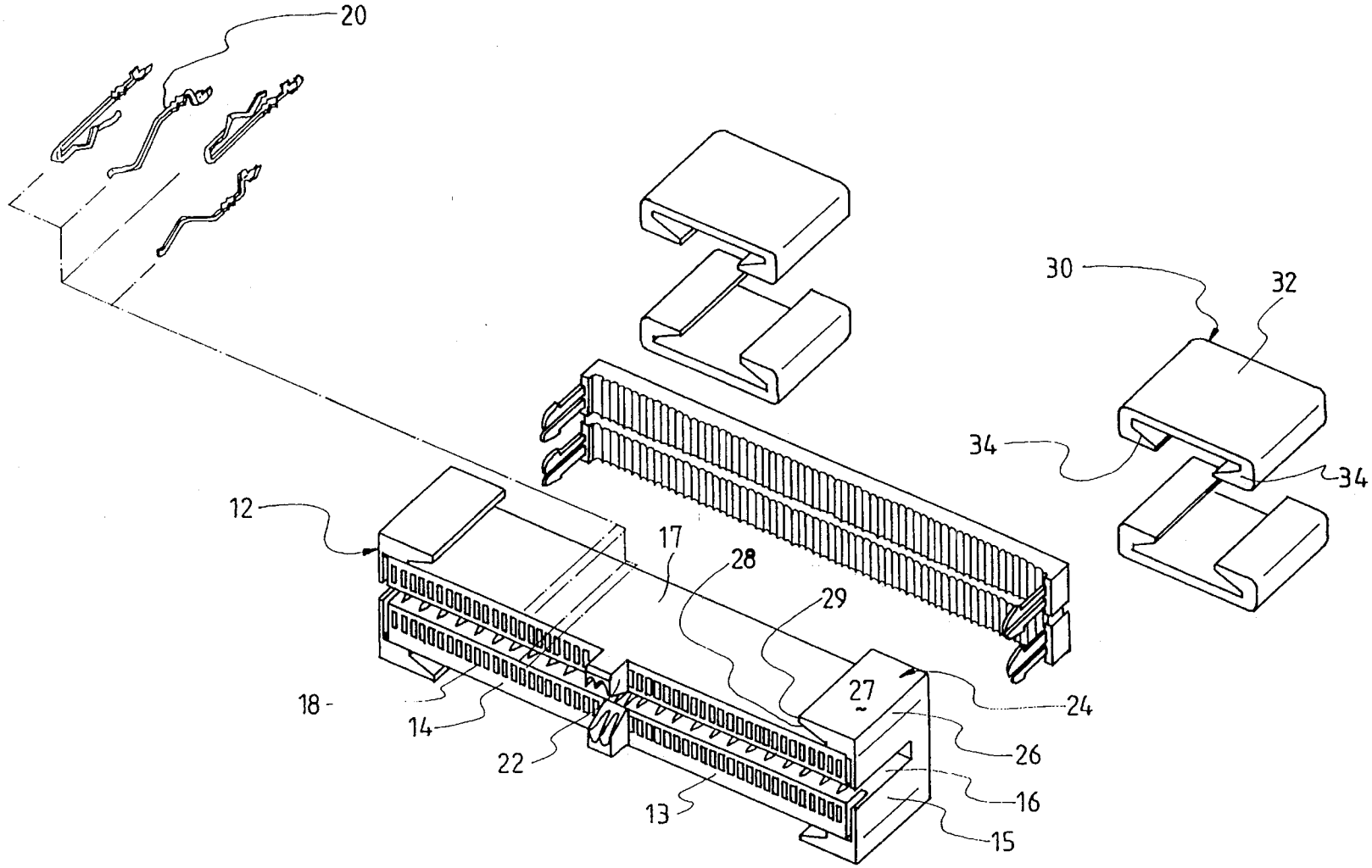
FIG. 3 is an enlarged perspective view of the individual module of FIG. 2 without two sets of contacts shown therein.

A pair of leading blocks 22 protrude upwardly out of the front surface 13 and at a midpoint of the housing 14 by two sides of the slot 16 for guiding the insertion of the board into the slot 16. A pair of wedge blocks 24 integrally protrude laterally on two sides of each end of the housing 14. Referring to FIG. 3, the wedge block 24 generally comprises a bottom surface 26, a side surface 27 and a tapered surface 28 wherein the bottom surface 26 is substantially coplanar with the end surface 15 of the housing 14, the side surface 27 is generally parallel to and spaced from the side surface 17 of the housing 14, and the tapered section 26 of the wedge block 24 faces to and extends away from the side surface 17 of the housing 14. The apex 29 of the wedge block 24 is substantially spaced and far away from the end surface 15 of the housing 14.

The fastening clip 30 comprises a plate 32 and two wedge portions 34 at two opposite ends wherein the dimension of the plate 32 is generally twice that of side surface 27 of the wedge block 24, and the dimension of the wedge portion 34 is generally equal to that of the tapered surface 28 of the wedge block 24.

When assembled, two adjacent connector module 12 are connected to each other by the fastening clip 30 in the lengthwise direction in an end-to-end relation wherein the right end surface 15 of the module housing 14 tightly abut against the left end surface 15 of another adjacent module housing 14. Similarly, the bottom surface 26 of the wedge block 24 also tightly abuts against the corresponding bottom surface 26 of another adjacent wedge block 24 of the adjacent module 12. The fastening clip 30 grasps the two adjacent juxtaposed wedge blocks 24 of the two adjacent modules 12 wherein the plate 32 of the fastening clip 30 covers both the side surfaces 27 of such two adjacent wedge blocks 24, and two opposite wedge portions 34 respectively engage the tapered surfaces 28 of such two adjacent wedge blocks 24. Therefore, the adjacent two modules 12 can be connected and confined along the lengthwise direction and the lateral direction of the whole connector assembly 1.

The limitation to the mutual movement of the modules 12 of the connector assembly 1 in the front-to-end direction, i.e., the insertion direction of the board, may be achieved by several different ways. One method is disclosed in FIGS. 4(A) and 4(B) wherein the rear side of the wedge block 24 includes a shoulder 25 so that the rear side of the fastening clip 30 can move to the corresponding wedge blocks 24 in a front-to-end direction and be seated thereon without further rearward movement. Also, a recess 21 is formed under the side surface 27 of the wedge block 24 for engagement with a tang 36 of the fastening clip 30 wherein such tang 36 obliquely extends forwardly and downwardly and can abut against the wall of the recess 21 for preventing the clip 30 from forwardly moving after such clip 30 completely grasps and covers the corresponding two adjacent wedge blocks 24 of the adjacent modules 12.

The other method can be referred to FIG. 5 wherein such clip 30, which is made of metal sheet in place of plastic used in the previous embodiment, can further have a front wall 37 and a rear wall 38. The front wall 37 is not formed by bending until the clip 30 has been assembled to the wedge blocks 24 from the back and such rear wall 38 of the clip 30 abuts against the rear surfaces of the wedge blocks 24.

It is also understood that by removing less contacts of the module 12 around the wedge blocks 24, the clips 30 on the two sides, i.e., the top side and the bottom side, of the housing 14 can be joined together by an intermediate section 40 to form a one piece as shown in FIG. 6 which provides a better structure for fastening and aligning the two corresponding adjacent modules 12 together.

The advantages of the invention are as follows.

(1) As aforementioned in the beginning, using plural modules 12, 10 for an elongated connector assembly can avoid the warpage thereof along its lengthwise direction.

(2) In comparison with using an extra long unitary housing of the connector assembly, using plural less dimensioned modules can be easily arranged in mold design for the molding process, thus reducing the manufacturing cost and increasing the quantity.

(3) Understandably, different modules 12 may have different lengths including different numbers of contacts for compliance with the circuit design on the board which is adapted to be inserted therein. In most prior arts, the partitions of the frame prohibit the interchangeability among the different modules 12 along the lengthwise direction of such connector assembly. Differently, in the present invention, there is no frame or partitions to restrain the designated position of the individual module 12 or 10 in the whole connector assembly 1. The independent and separate fastening clip 30 allows for interchangeable positions among the different power and/or signal modules 10, 12 in the whole connector assembly 1. Thus, the present invention provides flexibility to meet the board circuit changes in different models of the computer.

Figure 2:
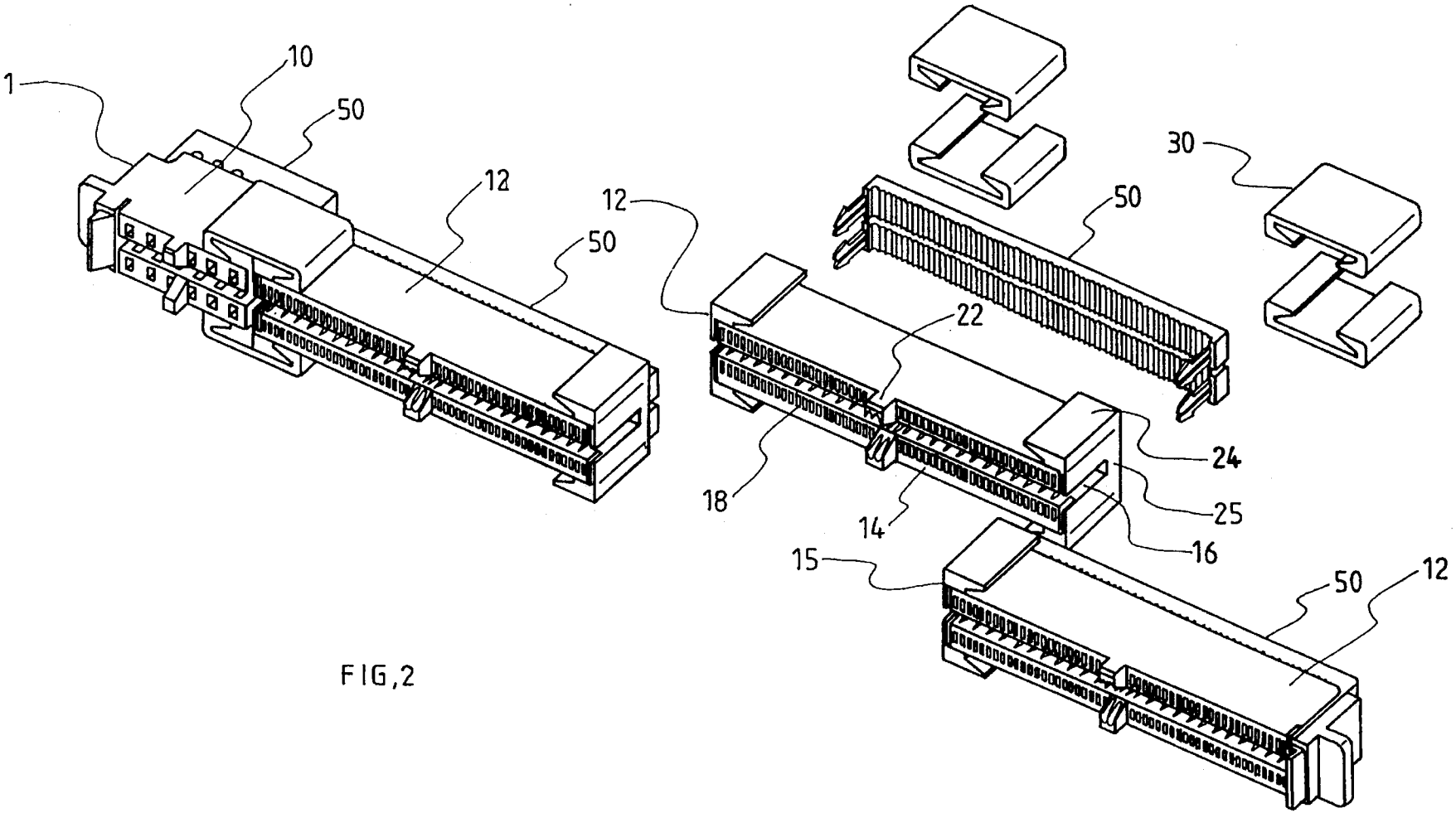
FIG. 2 is a perspective view of the assembled connector assembly of FIG. 1 wherein one module is exploded to illustrate the housing, the wedge block and the fastening clip.

(4) In U.S. Pat. No. 5,190,480, when using the IDC structure to connect the flat cables to the connector assembly sometimes may jeopardize the few contact tails of the connector assembly. In such situation, the whole connector assembly may be abandoned because it is in a form of unitary housing. Oppositely, in the present invention, in the same situation, i.e., by using a cover 50 as shown in FIGS. 1–3 to attach a flat cable (not shown) to the housing 14, only changing the module which has the damaged contact tails is required. Therefore, it can save the cost. It should be seen that using flat cables is one choice for the contact connection. Understandably, such connection also can be done by the contacts 20 directly solderably mounted on a mother board.

(5) Without the restraint of the frame, the connector assembly 1 in the present invention can be expandable or extendable in the lengthwise direction for conformance with the increasing requirements of the board inserted therein.

(6) Using the modular design, one module can have two rows of the contacts at the first and the second levels, and the other module can have two rows of contacts at the third and the fourth levels, as shown in FIGS. 7(A) and 7(B). Then, there are four levels in the whole connector assembly after these two modules assembled together. In other words, the insertion force of the board can be almost significantly reduced to one fourth of the original amount. In contrast, in U.S. Pat. No. 5,190,480, it is very different to have the contacts positioned at "four" different levels within one unitary housing according to the traditional manufacturing procedure. Thus, through its multiple levels of the internal contacts, the present invention can provide a better mating process between the connector assembly and the inserted board.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. An elongated electrical connector assembly (1) comprising:

a plurality of connector modules (12) positioned in mutually an end-to-end relationship along a lengthwise direction of said connector assembly (1), each module (12) including an insulative housing (14) having a plurality of cavities (18) for receiving a corresponding number of contacts (20) therein;

each module (12) further defining a central slot (16) extending therethrough in said lengthwise direction, and including engagement means (24) protruding laterally and upwardly from at least one side surface (17) of the housing (14) Wherein said surface (17) extends in a direction parallel to said lengthwise direction; and an external fastening means (30) cooperating with two adjacent opposite engagement means (24) of two adjacent modules (12) for aligning and fastening said two adjacent modules (12) together so that said connector assembly (1) can be extendable by adding additional modules (12) thereto along said lengthwise direction wherein said modules (12) can be interchanged in their lengthwise positions, and wherein due to the central slot (16) extending through each module (12) in the lengthwise direction, said connector assembly (10) defines an uninterrupted long slot for receiving therein a board which has an enormous length for enclosing a large number of circuits pads.

2. The connector assembly (1) as described in claim 1, wherein each said engagement means (24) of the module (12) is a wedge block (24) integrally extending from the housing (14), said wedge block (24) including a bottom surface (26), a side surface (27) and a tapered surface (28).

3. The connector assembly (1) as described in claim 2, wherein said fastening means (30) is a clip (30) including a plate (32) and two wedge portions (34) at two opposite ends, said clip (30) dimensioned for compliance with a configuration defined by the two adjacent wedge blocks (24).

4. The connector assembly as described in claim 1, wherein a first module (12) includes two rows of contacts (20) at a first and a second levels, and a second module (12) includes two rows of contacts (20) at a third and a fourth levels, for significantly reducing an insertion force of the board.

5. A module (12) for use within a electrical connector assembly (1) having a large dimension along a lengthwise direction, said module (12) comprising:

an elongated insulative housing (14) having a plurality of cavities (18) therein and defining a central slot (16) extending therethrough in said lengthwise direction;

a plurality of contacts (20) respectively received in the corresponding cavities (18); and engagement means (24) protruding upwardly and laterally from two opposite side surfaces (17) of housing (14) for an end-to-end latchable combination with another adjacent module (12); whereby the central slots (16) of the adjacent modules (12) can form an uninterrupted long slot for receiving therein a board which has an enormous length for enclosing a large number of contacts.

6. The module (12) as described in claim 5, wherein said latchable combination of two adjacent modules (12) are implemented by an external fastening means (30).

7. The module as described in claim 6, wherein each said engagement means (24) is a wedge block (24) including a side surface (27) generally parallel to a side surface (17) of the housing (14), a bottom surface (26) generally in coplanarity of an end surface (15) of the housing (14), and a tapered surface (28) extending away from the end surface (15) of the housing (14).

* * * * *